US006070875A

United States Patent [19]

Boylan et al.

[11] Patent Number: 6,070,875

[45] Date of Patent: Jun. 6, 2000

[54] BLACKJACK-TYPE WAGERING GAME

[75] Inventors: Eugene B. Boylan, Minden; Robert F. Koerner, Gardnerville; Russell Hebert, Carson City, all of Nev.; Scott McBride, Sault Ste. Marie, Canada

[73] Assignee: Bet Technology, Inc., Carson City, Nev.

[21] Appl. No.: 09/400,971

[22] Filed: Sep. 22, 1999

[51] Int. Cl.[7] ..... A63F 1/00

[52] U.S. Cl. ..... 273/292; 273/274; 273/303; 273/306; 463/13; 463/27

[58] Field of Search ..... 273/236, 274, 273/292, 303, 306; 463/13, 27

[56] References Cited

U.S. PATENT DOCUMENTS

| | | | |
|---|---|---|---|
| 5,257,810 | 11/1993 | Schorr et al. | 273/292 |
| 5,275,416 | 1/1994 | Schorr et al. | 273/292 |
| 5,314,193 | 5/1994 | Ferrer | 273/292 |
| 5,366,228 | 11/1994 | Kangsanaraks | 273/292 |
| 5,476,265 | 12/1995 | Miller et al. | 273/292 |
| 5,615,888 | 4/1997 | Lofink et al. | 273/292 |
| 5,639,092 | 6/1997 | Macaisa | 273/292 |
| 5,653,445 | 8/1997 | Quach | 273/292 |
| 5,806,846 | 9/1998 | Lofink et al. | 273/292 |
| 5,810,354 | 9/1998 | Banyai | 273/292 |
| 5,823,536 | 10/1998 | Flasch | 273/292 |
| 5,851,011 | 12/1998 | Lott | 273/292 |

OTHER PUBLICATIONS

Scarne's Encyclopedia of Games–John Scarne–pp. 276–290, 1973.

*Primary Examiner*—Jeanette Chapman
*Assistant Examiner*—Delores Collins
*Attorney, Agent, or Firm*—Larson & Taylor

[57] ABSTRACT

A method of playing a blackjack-type wagering game where the playing cards have ranks and suits. Initially, the dealer deals a hand to each player making an ante bet and the banker. This dealing step includes the step of hitting each player and the banker as desired thereby. Next, it is determined whether each player has a winning hand, a losing hand or a push hand. For each push hand, it is then determined whether a poker value of that push hand is greater than or less that of the banker's. Finally, the ante bet of each respective player is paid to (a) each respective player if each respective player has a total hand value considered a winner over a total hand value of the banker or for a push hand if the poker value is greater than the banker's, or (b) the banker if each respective player has a total hand value considered a loser over a total hand value of the banker or for a push hand if the banker's poker value is greater than the player's. In a preferred embodiment, the dealing step includes allowing splits and hitting the hand of the banker until the total hand value is greater than 16. In addition, the valuing of a poker value is first by rank from higher to lower of ace to 2, and then by suit in the order of higher to lower of spades, hearts clubs, and diamonds.

6 Claims, No Drawings

BLACKJACK-TYPE WAGERING GAME

FIELD OF THE INVENTION

The present invention relates generally to a wagering game, and more particularly to a banking wagering game in which hands which tie in total hand value are then determined to be winners or losers based on a poker hand value.

BACKGROUND OF THE INVENTION

Typically in many wagering games, especially in banking wagering games using cards, a single ante wager is made at the beginning of each round of the game. The winning or losing of this ante wager is determined by the hand each player is dealt as it is valued against a hand of a banker. When ties result, the ante bet is often considered a "standoff" or "push", with neither the player or the banker winning the ante bet, so that the player retains the ante bet.

SUMMARY OF THE INVENTION

In accordance with the present invention, a method of playing a total hand value or blackjack-type wagering game between a respective player or a group of respective players and a banker is provided. The outcome of the game is determined by randomly generated playing cards, such as from a deck of standard playing cards, which have ranks and suits. The method of play begins with each respective player wagering an ante bet against the banker. After all bets are made, the dealer deals a hand, such as a blackjack hand, to each of the respective players and the banker. This dealing step includes the step of hitting each player as desired by that player and by the banker. As the game continues, it is determined whether each player has a winning hand, a losing hand or a push hand compared to the banker. This determining includes the step of further determining for each push hand whether a poker value of that push hand is greater than or less than a poker value of the hand of the banker. Finally, the ante bet of each respective player is paid to (a) each respective player if each respective player has a total hand value considered a winner over a total hand value of the banker, (b) the banker if each respective player has a total hand value considered a loser over a total hand value of the banker, (c) each respective player if the player has a total hand value equal to the total hand value of the banker, and if the player has a poker value of the hand greater than the poker value of the hand of the banker, and (d) the banker if the player has a total hand value equal to the total hand value of the banker, and if the player has a poker value of the hand less than the poker value of the hand of the banker.

In a preferred embodiment where the wagering game is blackjack or 21, the dealing step includes the steps of permitting each respective player receiving matched value cards with the first two cards dealt to split those cards into two hands which are then each played as a first card of a hand, as well as hitting the hand of the banker until the total hand value is greater than 16 so long as any player is still in the game. In addition, the further determining step includes the steps of valuing a poker value of each hand first by rank from higher to lower of ace to 2, and then by suit in the order of higher to lower of spades, hearts, clubs, and diamonds.

It is an advantage of the present invention that each ante bet is ultimately determined to be a winner or loser, so that the players experience an outcome for each hand even when tied in the usual play of the game.

It is also an advantage of the present invention that the banker achieves an advantage when players are allowed to split their initial hands so that the banker will have more pairs or higher of poker valued hands. This is especially relevant to wagering games where the house is both the banker and the dealer.

Other features and advantages of the present invention are stated in or apparent from detailed descriptions of presently preferred embodiments of the invention found hereinbelow.

DESCRIPTION OF THE PREFERRED EMBODIMENTS

The present invention is preferably played in the same manner as any value total wagering game with a bank, with the exception that no "push" or "standoff" hands result where the ante bet is returned to the player. As this varies from the normal wagering game, this exception must be prominently disclosed or understood by each player. A typical value total wagering game is blackjack or 21, and the present invention will be disclosed using that game as an example. However, it will be appreciated by those of ordinary skill in the art that the present invention is likewise applicable to other value total wagering games where the outcome is determined by randomly generated playing cards having various ranks and suits.

The present invention as demonstrated in a blackjack wagering game of the present invention is played in the same manner as the usual play of a blackjack game, and uses the same table layout. The only possible difference to the table layout might be indicia which indicates that no pushes or standoffs will occur due to the outcome determination for pushes as explained hereafter. As with the usual blackjack game, each player places an ante bet at a suitable or designated location on the table which constitutes a wager against a banker at the table. After all ante wagers are made, the dealer deals a blackjack hand to each player and to the banker. In the usual manner, each player is then asked by the dealer in turn whether to hit or apply another card to that player's hand, up to the point where the player's total hand value exceeds 21 (is equal to or greater than 22). Finally, the dealer either deals hits to the banker's hand—the determination of the banker's hits usually being prescribed by the house as the method of play. For the present invention, a house method of play is that the banker will take a hit until his total hand value is greater than 16 (i.e., 17 or above). Of course, the banker need not take any hit if all players are busted (having a total hand value exceeding 21, i.e., 22 or greater), but the banker will take a hit when the hand total is less than 17 even if all remaining players have a total equal to or less than the total of the banker.

As in the usual blackjack game, as soon as any player's total hand value equals or exceeds 22, the player is busted and the dealer immediately determines that the hand of the player is a loser so that the banker then collects or pays off that player's ante bet to the banker. Otherwise, after all dealing and hits are complete, including those of the banker, a determination is made as to whether each player has a winning hand, a losing hand, or a push (or standoff) hand compared to the hand of the banker. In addition, for each push hand, a further determining step is performed to determine whether a poker value of each push hand is greater than or less than a poker value of the hand of the banker.

The determination of poker value is made first by rank. This includes pairs and so forth, but typically it will be the rank of the highest card of each hand (or succession of ranked cards if the highest ranked cards are of equal rank). As in poker, the ranks run higher to lower from ace to 2. In cases of ties in the ranks of all cards, the higher poker value is determined by suit starting from the highest ranked card of each hand (or succession of ranked cards if the highest rank cards are of equal rank). While suits are usually considered of equal value in poker, in this preferred embodiment of the present invention the value of the suits is chosen in the order from highest to lowest is spades, hearts, clubs, and diamonds. Of course, other orders of suit can be made if desired.

By way of example, when the player and banker have the same total (limited to 17, 18, 19, 20 and 21 as noted above since the banker must hit when below 17), the following outcomes result from the following hands.

| winning hand | losing hand | rationale |
|---|---|---|
| K, K | A, 9 | pair beats non-pair |
| K, K | Q, Q | higher pair beats lower pair |
| A, 9 | Q, 10 | highest rank card |
| 9, 7, 2, 2 | J, 10 | pair beats non-pair |
| 3, 3, 3, A | 9, 7, 2, 2 | three of a kind beats pair |
| K♠, Q♦ | K♥, Q♣ | king of spades has a higher value than king of hearts - where highest cards are of equal rank |
| K♠, Q♥ | K♠, Q♦ | queen of hearts has a higher value than queen of diamonds - where highest ranked cards are kings of the same suit and next highest ranked cards (queens) are of equal rank |

It will be appreciated that it is possible for two hands to have cards which are the same (as K♠, Q♥) as typical banking games use multiple decks of cards. Thus, it would even be possible (though highly unlikely) for the poker values of two hands to be the same. In such a rare case, the tied poker value hands would be considered a push or standoff, so that the ante bet of the tied player would be returned to that player.

After determining whether each hand of a player is a winner or loser, the banker pays off of the ante bet of each respective player. This payoff is made to: (a) each respective player if each respective player has a total hand value greater than a total hand value of the banker, but less than 22 (21 or lower), (b) the banker if each respective player exceeded a total hand value of 21 (was busted) or has a total hand value less than that of the banker, (c) each respective player if the player has a total hand value equal to the total hand value of the banker and less than 22 (was not busted prior to the banker taking a hit which busted the banker), and if the player has a poker value of the hand greater than the poker value of the hand of the banker, and (d) the banker if the player has a total hand value equal to the total hand value of the banker and less than 22, and if the player has a poker value of the hand less than the poker value of the hand of the banker.

In the preferred embodiment of the present invention, a house method of play requires the step of the banker taking a hit until the banker's total is greater than 16 (17 or more). This step only applies, of course, if some player remains in the game—otherwise, the banker has already won.

In the preferred embodiment of the present invention, it will also be appreciated that the house method of play includes the option for each player, upon receiving the first two cards of equal value (pairs or all values of 10), to split the two cards into two first cards of two separate hands. When this occurs, the player must wager an additional ante bet on one (the second) hand, and the dealer then deals a second card and hits as desired to each hand in turn and play of the blackjack game continues as described above. This splitting option provides a house advantage to the method of play of the present invention since the banker is not afforded this option and thus the banker will be more likely to have a pair (or three, four, five, etc. of a kind) than a player. The number of additional wins for a banker will thus be determined by the number of players and hands dealt each hour, but it is expected to be about ¼ to ½ a hand each hour for a typical Vegas-type game.

Although the present invention has been described with reference to a typical blackjack or 21 card game, it will be appreciated that the method of play of the present invention is also adaptable to other similar card games. The method of play is also usable in video games and the like in the exact same manner, and in that regard the designations of dealers and cards are considered to include virtual and computer generated versions thereof.

While the present invention has been described with respect to exemplary embodiments thereof, it will be understood by those of ordinary skill in the art that variations and modifications can be effected within the scope and spirit of the invention.

We claim:

1. A method of playing a total hand value wagering game between a respective player or a group of respective players and a banker whose outcome is determined by randomly generated playing cards having various ranks and suits, said method comprising the steps of:

wagering of an ante bet by each respective player against the banker;

dealing of hands to each of the respective players and the banker, including the step of hitting each player as desired by that player and by the banker;

determining whether each player has a winning hand, a losing hand or a push hand compared to the banker based on the total values of the hands of the players and banker, including the step of further determining for each push hand whether a poker value of that push hand is greater than or less than a poker value of the hand of the banker; and paying off of the ante bet of each respective player to (a) each respective player if each respective player has a total hand value considered a winner over a total hand value of the banker, (b) the banker if each respective player has a total hand value considered a loser over a total hand value of the banker, (c) each respective player if the player has a total hand value equal to the total hand value of the banker, and if the player has a poker value of the hand greater than the poker value of the hand of the banker, and (d) the banker if the player has a total hand value equal to the total hand value of the banker, and if the player has a poker value of the hand less than the poker value of the hand of the banker.

2. A method of playing a total hand value wagering game as claimed in claim 1:

wherein the playing cards are a standard deck; and wherein said further determining step includes the steps valuing a poker value of each hand first by rank from higher to lower of ace to 2, and then by suit in the order from higher to lower of spades, hearts clubs, and diamonds.

3. A method of playing a blackjack-type wagering game between a respective player or a group of respective players and a banker whose outcome is determined by randomly generated playing cards from a deck of standard playing cards which have ranks and suits, said method comprising the steps of:

wagering of an ante bet by each respective player against the banker;

dealing of blackjack hands to each of the respective players and the banker, including the step of hitting each player as desired by that player and by the banker;

determining whether each player has a winning hand, a losing hand or a push hand compared to the banker, including the step of further determining for each push hand whether a poker value of that push hand is greater than or less than a poker value of the hand of the banker; and paying off of the ante bet of each respective player to (a) each respective player if each respective player has a total hand value greater than a total hand value of the banker, but less than 22, (b) the banker if each respective player exceeded a total hand value of 21 or has a total hand value less than that of the banker, (c) each respective player if the player has a total hand value equal to the total hand value of the banker and less than 22, and if the player has a poker value of the hand greater than the poker value of the hand of the banker, and (d) the banker if the player has a total hand value equal to the total hand value of the banker and less than 22, and if the player has a poker value of the hand less than the poker value of the hand of the banker.

4. A method of playing a blackjack-type wagering game as claimed in claim 3, wherein said dealing step includes the steps of:

permitting each respective player receiving matched value cards with the first two cards dealt to split those cards into two hands which are then each played as a first card of a hand; and hitting the hand of the banker until the total hand value is greater than 16 so long as any player remains in the game.

5. A method of playing a blackjack-type wagering game as claimed in claim 3, wherein said further determining step includes the steps of valuing a poker value of each hand first by rank from higher to lower of ace to 2, and then by suit in the order of higher to lower of spades, hearts clubs, and diamonds.

6. A method of playing a blackjack-type wagering game as claimed in claim 4, wherein said further determining step includes the steps of valuing a poker value of each hand first by rank from higher to lower of ace to 2, and then by suit in the order of higher to lower of spades, hearts clubs, and diamonds.

* * * * *